United States Patent [19]

Rose

[11] Patent Number: 4,651,449

[45] Date of Patent: Mar. 24, 1987

[54] CHAIN SAW CHAIN FOR DIGGING TRENCHES

[76] Inventor: William Rose, P.O. Box 832, McMinnville, Oreg. 97128

[21] Appl. No.: 744,797

[22] Filed: Jun. 13, 1985

[51] Int. Cl.[4] ..... E02F 3/14; E02F 5/06

[52] U.S. Cl. ..... 37/191 A; 37/191 R; 37/96

[58] Field of Search ..... 37/86, 191 R, 191 A

[56] References Cited

U.S. PATENT DOCUMENTS

| | | | |
|---|---|---|---|
| 1,284,447 | 11/1918 | Poulter | 37/86 |
| 2,211,525 | 8/1940 | Stenger et al. | 37/191 A |
| 2,991,571 | 7/1961 | Hyster | 37/191 A |
| 2,997,276 | 8/1961 | Davis | 31/191 A X |
| 3,104,481 | 9/1963 | George et al. | 37/191 A X |
| 3,614,838 | 10/1971 | Wherry | 37/191 A X |
| 3,754,341 | 8/1973 | Caldwell et al. | 37/191 A X |
| 3,834,049 | 9/1974 | Bond | 37/191 A X |
| 3,846,922 | 11/1974 | Horton | 37/191 A X |
| 3,979,843 | 9/1976 | Nissen | 37/86 |
| 4,429,477 | 2/1984 | Tice et al. | 37/191 A X |

*Primary Examiner*—Edgar S. Burr
*Assistant Examiner*—James R. McDaniel
*Attorney, Agent, or Firm*—Chernoff, Vilhauer, McClung & Stenzel

[57] ABSTRACT

A trench-digging chain mountable on a chain saw with no more than minor modification of shielding includes high, narrow cutters on the side of the chain closer to the engine and clutch of the chain saw power unit and low, wide carrier teeth on the opposite side of the chain. The narrow width permits installation of the chain in the clearance normally provided between a drive sprocket and the engine. The carrier teeth include a surface which is approximately horizontal during use, to carry material upwardly out of a trench being dug. Intermediate links include roots to be driven by the drive sprocket and slide in the peripheral guide channel of the saw bar.

6 Claims, 7 Drawing Figures

CHAIN SAW CHAIN FOR DIGGING TRENCHES

BACKGROUND OF THE INVENTION

The present invention relates to digging slit trenches, and particularly to an endless chain for use in combination with a conventional chain saw drive unit for digging such trenches.

It is often necessary to dig trenches in which to bury conduits for electrical power hookups between an electrical power main cable and a house, or for similar burying of television antenna cables, telephone cables, water supply pipes, and lawn sprinkling system piping. Where such narrow cables and pipes are installed in an area which has been landscaped, it is preferable to provide a narrow trench of the required depth, instead of causing a much greater amount of destruction of existing landscaping by using shovels or conventional backhoes and other large power tools. Also, certain types of terrain, such as steeply sloped or terraced areas, are not well adapted for the use of large power tools.

Conventional ditching machines use wheels carrying shovels, and are also excessively large for many jobs. It is known to use a small, lightweight gasoline engine, however, to drive small trenching tools including endless chains carrying teeth designed to dig a narrow slit trench for use in situations such as those mentioned above.

Conventional chain saws provide a readily available small gasoline engine, combined with a clutch and a supporting bar structure normally used to guide and hold a saw chain carrying wood-cutting teeth. Such a saw chain is an endless loop driven by a sprocket connected through the clutch to the engine, so that the chain can be driven at high speed along the periphery of the saw bar.

While it is desirable to use such a power source to drive a chain designed for digging a narrow trench, such a chain saw drive unit typically requires significant amounts of modification in order for the previously known trenching chains to be driven. In particular, there is ordinarily too little clearance for digging teeth of a practical size, because of the closeness of the drive sprocket to the clutch provided on a chain saw drive unit. Additionally, the splinter shield provided around the drive sprocket of a chain saw usually provides too little radial clearance for trenching teeth of desirable size.

While some wear and damage to trenching teeth carried on a chain is inevitable, it is desirable to minimize the amount of damage which might be caused should an immovable object such as a large rock be struck by the teeth of a trench digging chain.

Additionally, the trenching teeth previously used have not been particularly well adapted for carrying loosened dirt upward within a trench being dug by such chain-carried teeth.

What is desired, then, is an improved trench-digging chain which can be utilized in combination with the engine, clutch, and chain bar of a chain saw to dig narrow trenches more efficiently than can be done with a normal wood-cutting saw chain, which may be installed on a chain saw drive unit with a minimum of modification of the drive unit, and whose construction minimizes damage incurred when hard objects are met.

SUMMARY OF THE INVENTION

The present invention provides an endless loop of trench-digging chain which is compatible with the normal drive sprocket, clutch, and saw bar of a conventional chain saw. For example, a trencher chain comprises centrally-located single plate links including sprocket-engaging roots which slide in the peripheral chain guide groove provided along the edges of a chain saw guide bar. The single plate links are connected by double plate links in which parallel pairs of plates are riveted together, with the rivets extending pivotably through holes in the ends of the single plate links which the double plate links connect.

Cutters are provided on one side of the endless loop of chain. Each cutter includes one side plate of the respective pair, and has a cutter base portion having a height of, for example, $\frac{5}{8}$ inch, and a laterally extending portion at the outer end of the base portion, extending about 3/16 inch in the direction away from the chain. This small width, combined with a relatively large height, assures that there is clearance for the chain, when installed on the drive sprocket and saw bar, to pass clear of the clutch usually provided to drive the sprocket.

On the opposite side of the chain, that is, the side of the chain facing away from the engine, are carriers which also include the respective ones of the side plates on that side of the double plate links of the chain. Each of the carriers includes a carrier base portion which is an enlargement of the normal side plate of a double plate link, and a laterally outwardly extending portion. In the carriers, however, the height of the carrier base portion is significantly smaller than the height of the cutter base portion of the cutters. A carrier blade extends laterally outward away from the side of the chain saw bar, in the direction away from the drive clutch, a distance greater than the width of the cutter. The carrier width may be, for example, $\frac{7}{8}$ inch. The carrier blade is oriented at an angle to the length of the chain, so that when the chain saw bar is held in a downwardly inclined attitude, with its nose lower than the engine, as would be the case when digging a trench, the upper surfaces of the blades on the bottom side of the saw bar are approximately horizontal. This contributes to carrying loose dirt rapidly upward from within the trench.

Because the cutters extend further away from the chain, they first encounter the soil, loosening it. The carriers then remove the loosened earth from within the trench being dug, widening the trench, carrying the loosened material upwardly and discharging it onto the ground alongside the trench. The small overall size of a chain equipped with cutters and carriers according to the present invention permits its installation on a chain saw without modification except for minor alteration of the cover plates provided in the vicinity of the drive sprocket to provide additional clearance.

It is therefore a principal object of the present invention to provide an improved combination of cutters and carriers for use on an endless chain for digging trenches.

It is another important object of the present invention to provide a chain which can be used for digging a trench and which can be driven by a chain saw engine in the same way in which an ordinary saw chain is used.

It is an important feature of the present invention that it provides a trencher chain having cutters which extend to a greater height above the chain than do the carriers which remove earth from a trench after it has been loosened by the cutters.

It is another important feature of the invention that it provides carriers including laterally extending portions which are operatively oriented generally horizontally to carry loosened soil during use of the trencher chain.

It is an important advantage of the trencher chain of the present invention that it is significantly cheaper to manufacture than previously available trencher chains.

It is another important advantage of the present invention that it provides a trencher chain which can reliably dig trenches which are large enough for installation of water pipes, cables, and the like, while causing only a minimum amount of damage to landscaped areas.

The foregoing and other objects, features and advantages of the present invention will be more readily understood upon consideration of the following detailed description of the invention taken in conjunction with the accompanying drawings.

DETAILED DESCRIPTION OF THE INVENTION

Figure 1:
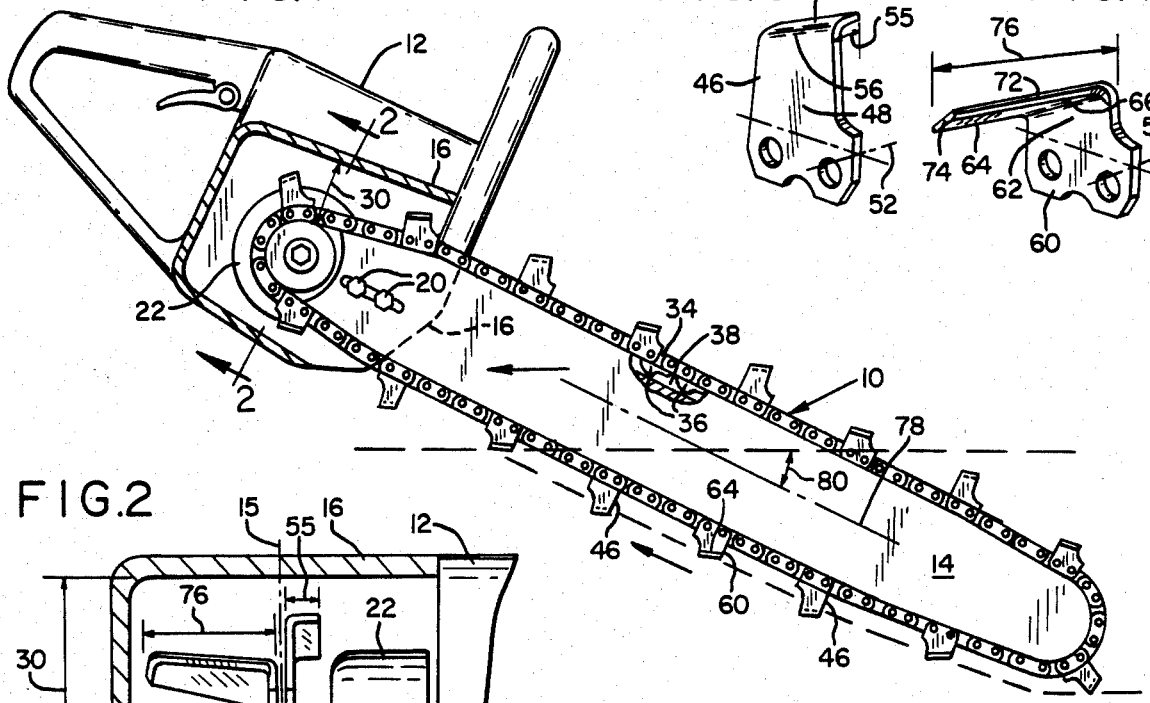
FIG. 1 is a side elevational view of a chain saw equipped with a trenching chain according to the present invention, being used for digging a narrow trench.
Figure 6:
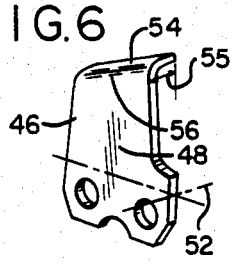
FIG. 6 is a perspective view of a cutter of the type included in the trencher chain of the invention.
Figure 7:
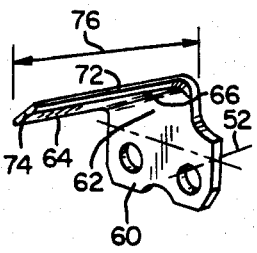
FIG. 7 is a perspective view of a carrier of the type included in the trencher chain of the invention.
Figure 2:
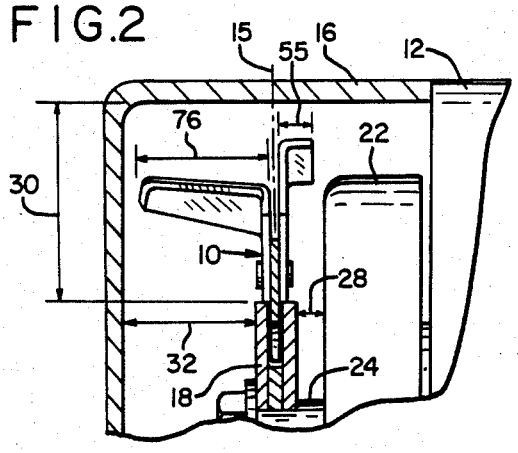
FIG. 2 is a sectional view, taken along line 2—2, of the chain saw and trencher chain combination of FIG. 1.

Referring now to the drawings, a trencher chain 10 according to the present invention is shown in FIG. 1 in use on a chain saw drive unit 12 having a saw bar 14. The chain 10 is an endless loop defining a chain plane 15 (see FIG. 2). A protective shield 16 (shown partly cutaway) covers a drive sprocket 18 and is attached by bolts 20 which also hold the saw bar 14 in place on the drive unit 12, to provide the proper amount of tension in the trencher chain 10. A clutch 22 is part of the chain saw drive unit 12 and is typically a centrifugal clutch. The clutch 22 is connected to a drive shaft 24 on which the drive sprocket 18 is fixedly mounted in alignment with the saw bar 14. An inner lateral clearance 28 is provided between the drive sprocket 18 and the clutch 22. A radial clearance 30 exists radially about the drive sprocket 18 and within the innermost surfaces of the shield 16. An outer lateral clearance 32 is defined between the drive sprocket 18 and the inner surface of the shield 16, on the side of the sprocket 18 facing away from the clutch 22.

Figure 3:
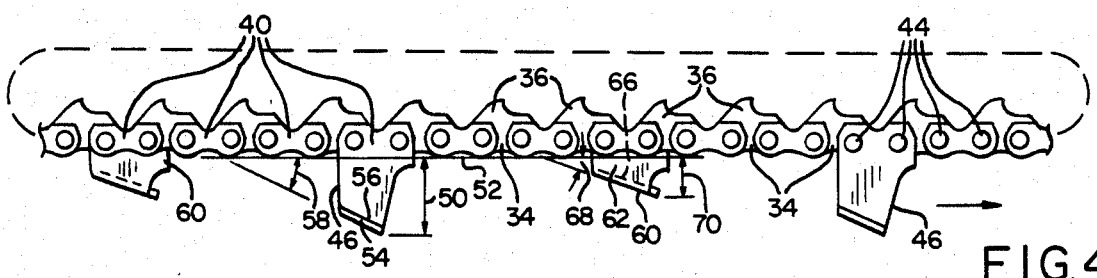
FIG. 3 is a left side view of a portion of the trencher chain according to the present invention.
Figure 4:
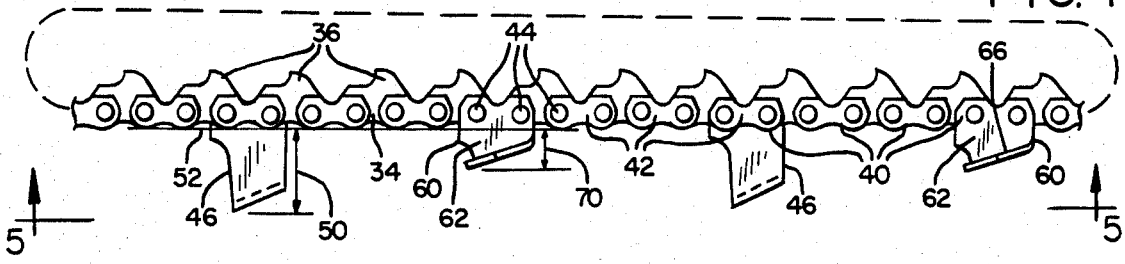
FIG. 4 is a right side view of the trencher chain according to the present invention.
Figure 5:
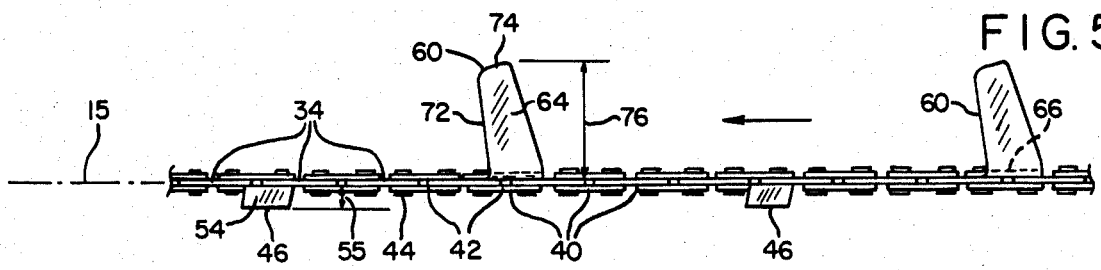
FIG. 5 is a bottom plan view of a length of trencher chain according to the present invention.

Referring now particularly to FIGS. 3–5, the trencher chain according to the present invention is an endless loop which includes a plurality of guide links 34 which are formed of a single flat plate and include a root portion 36 extending toward the interior of the loop of chain. The roots 36 are engaged by teeth of the drive sprocket 18 and slide around the periphery of the saw bar 14, within the peripheral chain guide channel 38 (FIG. 1), to prevent lateral motion of the trencher chain 10 with respect to the saw bar 14 during operation.

Located alternately between the single plate, or guide, links 34 are a plurality of double plate links 40 each including a pair of side plates 42 connected with one another by a pair of rivets 44 or other suitable fasteners which extend pivotably through holes provided in the opposite ends of the single plate links 34, permitting them to rotate about the rivets 44 with respect to the double plate links 40, as is well known in construction of saw chains.

Located at regularly spaced intervals along the trencher chain 10 are a plurality of cutters 46. The cutters 46 are formed integrally of sheet metal cut and bent to shape and include a portion equivalent to the side plates 42. Each cutter 46 includes a substantially planar cutter base portion 48 extending to a cutter height 50 beyond a base plane 52 defined by the radially outer surfaces of the single plate links 34, as shown in FIGS. 3 and 4. The cutter height 50 may, for example, be $\frac{7}{8}$ inch, for a chain of $\frac{3}{8}$-inch pitch, in a preferred embodiment of the present invention. A laterally extending portion 54 of the cutter 46 extends perpendicularly away from the cutter base portion 48, from a bend line 56 inclined at an angle 58 in the range of about 30° to 40°, and preferably 35°, to the base plane 52. The laterally extending portion 54 extends a distance of, for example, 3/16 inch laterally, defining a cutter width 55 so as to be able to fit within the inner lateral clearance 28 between the drive sprocket 26 and the clutch 22.

Located on the opposite (outer) side of the trencher chain 10, preferably spaced at equal intervals between the cutters 46, are an equal number of carriers 60. Like the cutters 46, the carriers 60 are formed integrally of sheet metal. The carriers 60 include a portion equivalent to respective ones of the side plates 42 on the outer side of the chain 10 and extend beyond the base plane 52 as a carrier base portion 62. Extending laterally away from the trencher chain 10 is a carrier blade portion 64 which extends generally perpendicularly from the carrier base portion 62, and may, like the lateral portion 54 of the cutters 46, be formed by bending the material of the carrier 60 along a bend line 66 which extends toward the base plane 52 at an angle 68 in the range of about 30° to 40°, and preferably 35°, defining a preferred carrier height 70 of about $\frac{3}{8}$ inch in a chain of $\frac{3}{8}$-inch pitch.

Preferably, the carrier blade 64 includes a leading edge 72 which is raked forward and ground to a beveled shape. The outer end of the carrier blade portion 64 has a swept-back tip 74 to help prevent the carrier blade 64 from snagging on roots and other articles with which it comes into contact during operation of the trencher chain 10. The carrier blade 64 extends outwardly from the trencher chain 10 to a carrier width 76 of, for example, $\frac{7}{8}$ inch, which is small enough to fit within the outer lateral clearance 32 provided within the shield 16, in many chain saws with which the chain 10 would be used.

Arranging the cutters and carriers on the chain so that the relatively narrow cutters are adjacent the chain saw body and the relatively wide carriers are remote from the chain saw body contributes to the ability of the trenching chain to fit upon many models of chain saws with little or no modification.

While the trencher chain 10 described is able to fit within the clearance provided within the shield 16 of many chain saw drive units, it will be necessary to modify the interior shape of some shields 16 to enlarge the radial clearance 30 and outer lateral clearance 32, or it may be necessary to provide spacers between the chain saw bar 14 and the shield 16 to increase the outer lateral clearance 32. In some cases, it may even be necessary to cut away a portion of the shield 16, leaving only the portion of the shield 16 which is inside the path of travel of the carriers 64, which may then extend laterally outward from the saw bar 14 to a distance greater than that which was originally provided within the outer lateral clearance 32 of that particular type of shield 16.

As will be appreciated, the cutter height 50, since it is greater than the carrier height 70, results in the initial cutting in a particular direction being accomplished by the cutters 46, which significantly loosen the soil through which trench is being dug by use of the trencher chain 10, driven by the chain saw drive 12. Should the cutters 46 encounter an object such as a large stone or a pipe which is not easily moved, the operator would cease further forward progress without any damage having been done to the carriers 60. Preferably, both the cutters 46 and the carriers 60 are of sheet steel of a thickness of, for example, about 0.05 inch, tempered to permit the cutters 46 and carriers 60 to bend a certain amount without breaking and to be restored to their proper configuration, also without breaking. For example a 1050 carbon steel, heat treated to a Rockwell "C" hardness of 28–29 has been found to be satisfactory for the carriers 60, while a Rockwell "C" hardness of 40–42 is preferred for the cutters 46, in view of their doing the initial loosening of soil. It is to be noted that both the carriers 60 and the cutters 46 are made from a flat blank of the same shape, with the lateral portion 54 of the cutters 46 being cut to the cutter width 56 after the blank is bent along the bend line 56.

As will be appreciated from FIG. 1, the carrier blades 64 and cutter lateral portions 54 extend substantially horizontally during use of the trencher chain in a downwardly directed attitude of the saw bar 14, in which the plane of the saw bar 14 is generally vertical and a longitudinal axis 78 of the saw bar 14 is at a convenient downward angle 80.

As a trench is dug by use of the trencher chain 10 on a chain saw drive 12, the soil is first loosened by the cutters 46 and the trench created thereby is increased by the width 76 of the carriers 60, which then lift the loosened soil on the generally horizontally extending surfaces of the carrier blades 64.

Preferably, hard soil is softened by soaking before the trencher chain 10 is used, and the chain 10 is lubricated frequently and liberally during use to minimize wear. Damage to the chain 10 is best avoided by proceeding slowly and carefully, running the chain saw drive 12 at a low engine speed. When the cutters 46 encounter a hard object the chain 10 should be stopped and the object removed, using a separate tool, before proceeding further.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An endless trenching chain for use in combination with a chain saw including a drive sprocket and a generally planar guide bar including an outwardly open peripheral chain guide channel, the chain comprising:

(a) a plurality of links pivotably interconnected with one another in an endless loop defining a chain plane in which all of said links are located;

(b) a plurality of cutters, each associated with one of said plurality of links and each having a cutter base portion oriented parallel with said chain plane and a cutter lateral portion extending away from said chain plane generally perpendicular to said cutter base portion, each of said cutters having a cutter height and said cutter lateral portion defining a cutter width which is less than said cutter height; and (c) a plurality of carriers, each associated with one of said plurality of links and each of said carriers having a carrier base portion oriented parallel with said chain plane and a carrier blade extending away from said chain plane generally perpendicular to said carrier base portion, said carrier base portion defining a carrier height which is less than said cutter height and said carrier blade defining a carrier width, said carrier width being greater than said carrier height, and all of said carriers being located on one side of said chain plane and all of said cutters being located on the side of said chain plane opposite said one side on which all of said carriers are located.

2. The chain of claim 1 wherein said cutters and said carriers are spaced apart from one another alternately along said endless loop of chain.

3. An endless trenching chain for use in combination with a chain saw including a drive sprocket and a generally planar guide bar including an outwardly open peripheral chain guide channel, the chain comprising:

(a) a plurality of links pivotably interconnected with one another in an endless loop defining a chain plane in which all of said links are located;

(b) a plurality of cutters, each associated with one of said plurality of links and each having a cutter base portion oriented parallel with said chain plane and a cutter lateral portion extending away from said chain plane generally perpendicular to said cutter base portion, each of said cutters having a cutter height and said cutter lateral portion defining a cutter width which is less than said cutter height;

(c) a plurality of carriers, each associated with one of said plurality of links and each of said carriers having a carrier base portion oriented parallel with said chain plane and a carrier blade extending away from said chain plane generally perpendicular to said carrier base portion, said carrier base portion defining a carrier height which is less than said cutter height and said carrier blade defining a carrier width, said carrier width being greater than said carrier height, and all of said carriers being located on one side of said chain plane; and (d) said carrier width being at least equal to said cutter height.

4. An endless trenching chain for use in combination with a chain saw including a drive sprocket and a generally planar guide bar including an outwardly open peripheral chain guide channel, the chain comprising:

(a) a plurality of links pivotably interconnected with one another in an endless loop defining a chain plane in which all of said links are located;

(b) a plurality of cutters, each associated with one of said plurality of links and each having a cutter base portion oriented parallel with said chain plane and a cutter lateral portion extending away from said chain plane generally perpendicular to said cutter base portion, each of said cutters having a cutter height and said cutter lateral portion defining a cutter width which is less than said cutter height;

(c) a plurality of carriers, each associated with one of said plurality of links and each of said carriers having a carrier base portion oriented parallel with said chain plane and a carrier blade extending away from said chain plane generally perpendicular to said carrier base portion, said carrier base portion defining a carrier height which is less than said cutter height and said carrier blade defining a carrier width, said carrier width being greater than said carrier height, and all of said carriers being located on one side of said chain plane; and (d) said chain defining a base plane extending along said chain perpendicular to said chain plane, and said carrier blade having a surface facing said base plane, said surface defining a carrier plane which intersects said base plane at an angle in the range of about 30° to 40°.

5. The chain of claim 3 wherein said carrier width is at least about four times as great as said cutter width.

6. The chain of claim 3 wherein said cutter width and said carrier width total at least about 1 inch.

* * * * *